343-700 MS AU 256 EX
3/15/77 OR 4,012,741

United States Patent [19]

Johnson

[11] 4,012,741

[45] Mar. 15, 1977

[54] MICROSTRIP ANTENNA STRUCTURE

[75] Inventor: Russell W. Johnson, Boulder, Colo.

[73] Assignee: Ball Corporation, Muncie, Ind.

[22] Filed: Oct. 7, 1975

[21] Appl. No.: 620,272

[52] U.S. Cl. ..... 343/700 MS; 343/853

[51] Int. Cl.[2] ..... H01Q 1/38

[58] Field of Search ..... 343/829, 846, 700 MS, 343/853, 854

[56] References Cited

UNITED STATES PATENTS

| | | | |
|---|---|---|---|
| 3,803,623 | 4/1974 | Charlot | 343/846 |
| 3,947,850 | 3/1976 | Kaloi | 343/795 |

*Primary Examiner*—Eli Lieberman
*Attorney, Agent, or Firm*—James D. Haynes

[57] ABSTRACT

A microstrip antenna radiator is disclosed which includes three edges spaced around its periphery defining three corresponding active slot areas wherein each slot has a different respectively corresponding resonant dimension associated therewith along a direction substantially transverse to the edge which defines the radiating slot. At least two dimensions of an essentially equilateral triangular shape are altered so as to provide the three different resonant dimensions for the radiator. Typically, at least two sides of such a triangular structure are altered such as by the formation of tab extensions or, alternatively, at least two apices of the basic triangular structure are truncated so as to produce different resonant dimensions in the radiator. Various combinations and permutations of such shape alterations may also be employed. Such a triangular microstrip radiator is especially adapted for elliptical or circular polarization and for utilization in arrays of such polarized elements wherein the triangular shape of each element permits a more nearly optimum spacing of the individual elements within one or more arrays.

16 Claims, 3 Drawing Figures

MICROSTRIP ANTENNA STRUCTURE

Figure 1:
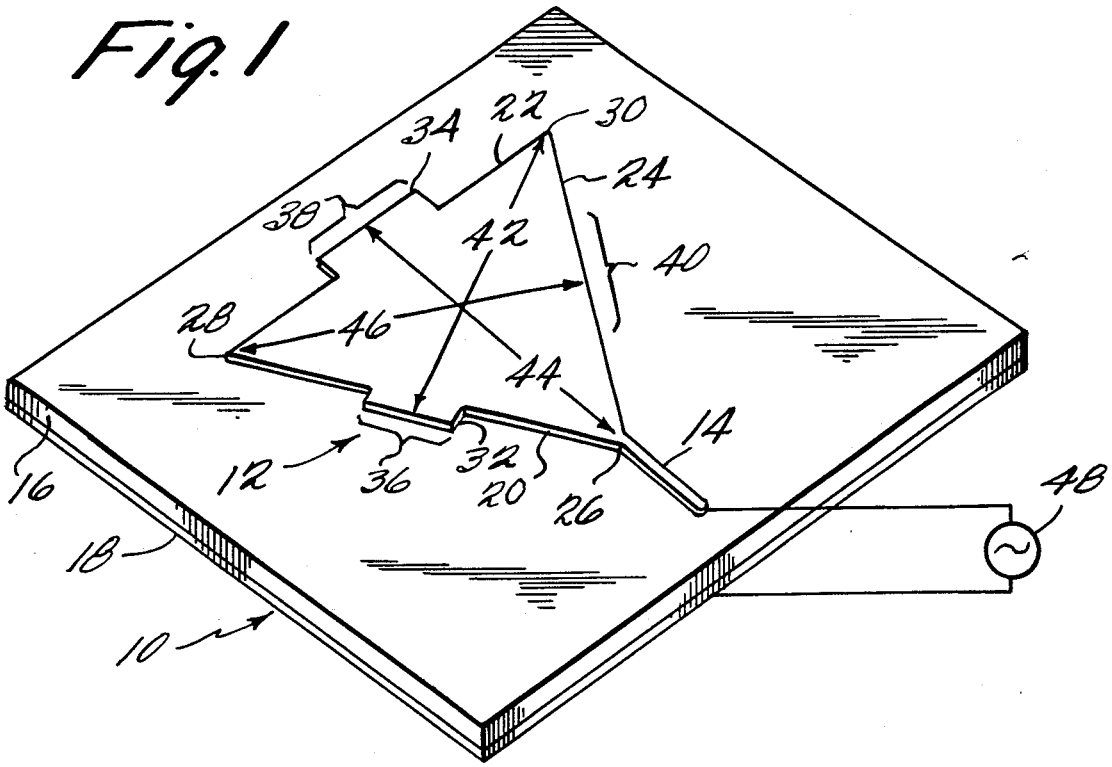

This invention generally relates to radio frequency antenna structures and, more particularly, to a uniquely shaped microstrip radiator element and to particular antenna arrays which utilize the uniquely shaped radiating elements so as to permit a more nearly optimum spacing of such elements within the arrays.

Microstrip antenna structures of various types are now well-known in the art by virtue of, inter alia, earlier already issued United States patents commonly assigned herewith such as U.S. Pat. Nos. 3,710,338; 3,713,166; 3,713,162; 3,810,183; and 3,811,128. There are also other copending commonly assigned United States patent applications relating to various microstrip antenna structures such as, for instance, application Ser. No. 352,005 filed Apr. 17, 1973 now U.S. Pat. No. 3,921,177. Another commonly assigned copending application herewith (Ser. No. 620,196 filed Oct. 6, 1975,) concerns the invention of Gary G. Sanford, for multiply resonant microstrip antenna radiator structures.

It will be appreciated by those in the art that microstrip radiators, per se, are specifically shaped and dimensioned conductive surfaces overlying a larger ground plane surface and spaced therefrom by a relatively small fraction of an electrical wavelength by virtue of an interspersed dielectric sheet. Typically, microstrip radiators are formed either singly or in arrays by photo-etching processes exactly similar to those utilized for conventionally forming printed circuit board structures of desired electrically conductive surface shapes. In fact, the starting material used for manufacturing microstrip radiator structures is quite similar to conventional printed circuit board stock in that it comprises a dielectric sheet laminated between two conductive sheets. Typically, one side of such laminated structure becomes the ground or reference plane for a microstrip antenna element or array while the other oppositely disposed surface of the laminated structure is photo-etched to form the actual microstrip shaped radiator or some array of such radiators usually integrally formed together with an appropriate microstrip transmission feedline structure for conducting radio frequency energy to and from the radiating elements. It is, of course, understood that antenna radiating structures may be used for either reception or transmission of radio frequency energy as desired.

While a variety of different shapes have been proposed for microstrip radiators under various circumstances, the conventional circularly polarized microstrip antenna element has been either substantially round or square in shape with shape being altered from exact roundness or exact squareness by an amount necessary to provide conjugate complex impedances along the orthogonal resonant axes of such radiators thereby producing the desired circular polarization. Of course, it should always be understood throughout the following discussion that circular polarization is but a special case of elliptical polarization and that, in fact, truly exact circular polarization is probably usually only approximated in actual practice by a form of elliptical polarization which approaches a truly circular polarization. Accordingly, throughout this and the following discussion, elliptical and circular polarization will be considered as synonymous one with another.

When such conventionally shaped circularly polarized antenna radiators are arrayed their necessarily substantial dimensions in terms of electrical wavelength along their orthogonal resonant axes presents a physical limitation on the spacing of array elements. This limitation is especially critical when two different arrays, each operating at a different center frequency, are interleaved as is often attempted when overall antenna size is a factor.

Now, however, it has been discovered that an essentially triangularly shaped microstrip radiator may be utilized as a circularly polarized antenna radiator. Using such a triangular radiator shape rather than the conventional round or square shape, it is possible to package more radiator elements within a given area. While such space saving is of general usefulness, it is of particular value when building multiple frequency antenna arrays which are interleaved since every other element in the interleaved combination of arrays may be inverted such that it complements the neighboring triangular shapes and thus optimizes the space usage available for the overall antenna function.

The substantially triangular shape of the antenna radiator utilized in the exemplary embodiment of this invention provides a radiating surface which includes three edges spaced apart about its periphery defining three corresponding active radiating slot areas wherein each slot has a different respectively corresponding resonant dimension associated therewith along a direction substantially transverse to the edge which defines the particular radiating slot under consideration.

If an equilateral triangular shape is considered as being fed by an appropriate transmission line at one of its edges or apices, it will be appreciated that each of the three sides of the triangle will define a radiating slot having an effective resonant dimension corresponding to the perpendicular distance from any given side to the oppositely situated apex of the triangular shape. In the exemplary embodiments to be described in more detail below, this set of three resonant dimensions associated with the three edges of the triangular structure are caused to take on mutually different values by virtue of some judicious alteration in the basic equilateral triangular shape. For instance, a given resonant dimension might be extended by forming a tab extension on the respectively associated edge of the triangular structure. Such dimension might also be decreased by truncating the respectively associated apex of the triangular structure. Other types of shape alterations effective for modifying the resonant dimensions of the three radiating slots will be apparent from the following discussion and/or from various combinations or permutations of the exemplary shape alterations described in detail herein below.

In the exemplary embodiment, such a triangularly shaped radiator is caused to be circularly polarized by making one of the resonant dimensions resonant at the expected operating frequency and by making the other two resonant dimensions slightly different therefrom so as to produce leading and lagging radiated fields which are appropriately related in time and in space so as to produce the desired polarization. For example, in the exemplary embodiment which utilizes a basically equilateral triangular structure, the three radiating slots are spatially oriented at 120° angular intervals and, accordingly, one slot is caused to lag by 120 electrical degrees while another slot is caused to lead by 120 electrical degrees with respect to the third remaining slot. As will be appreciated upon reflection, this particular arrangement will produce either right or left-hand circularly polarized radiation (depending upon which slot is chosen to lead and which slot is chosen to lag).

Figure 2:
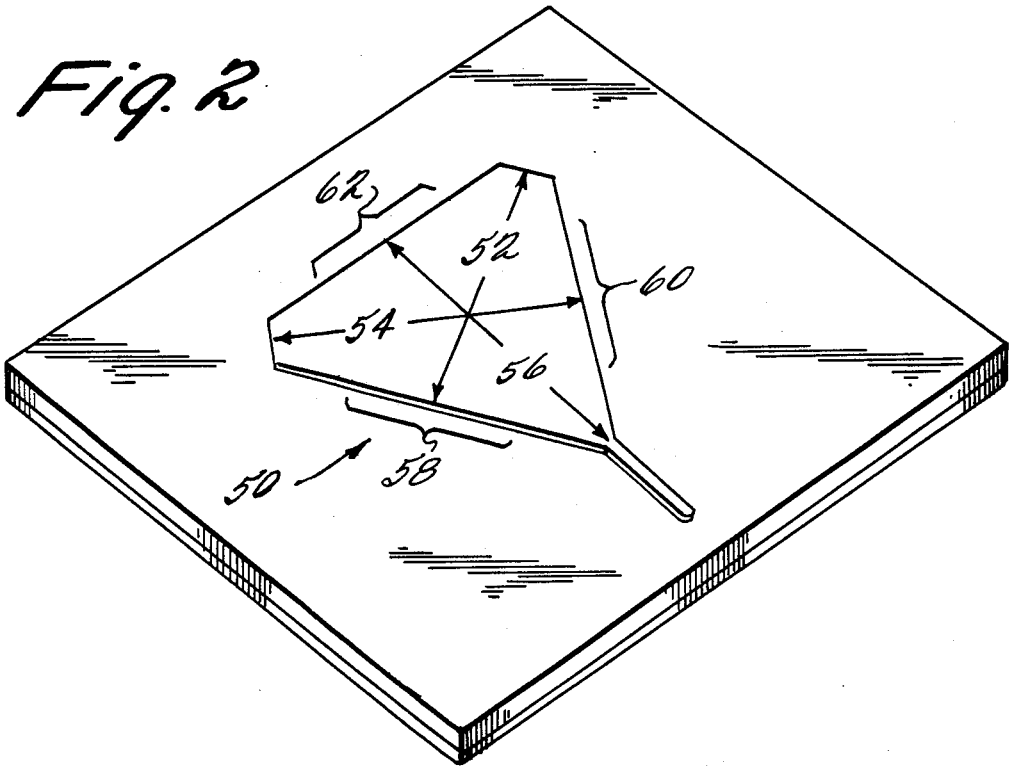
Figure 3:
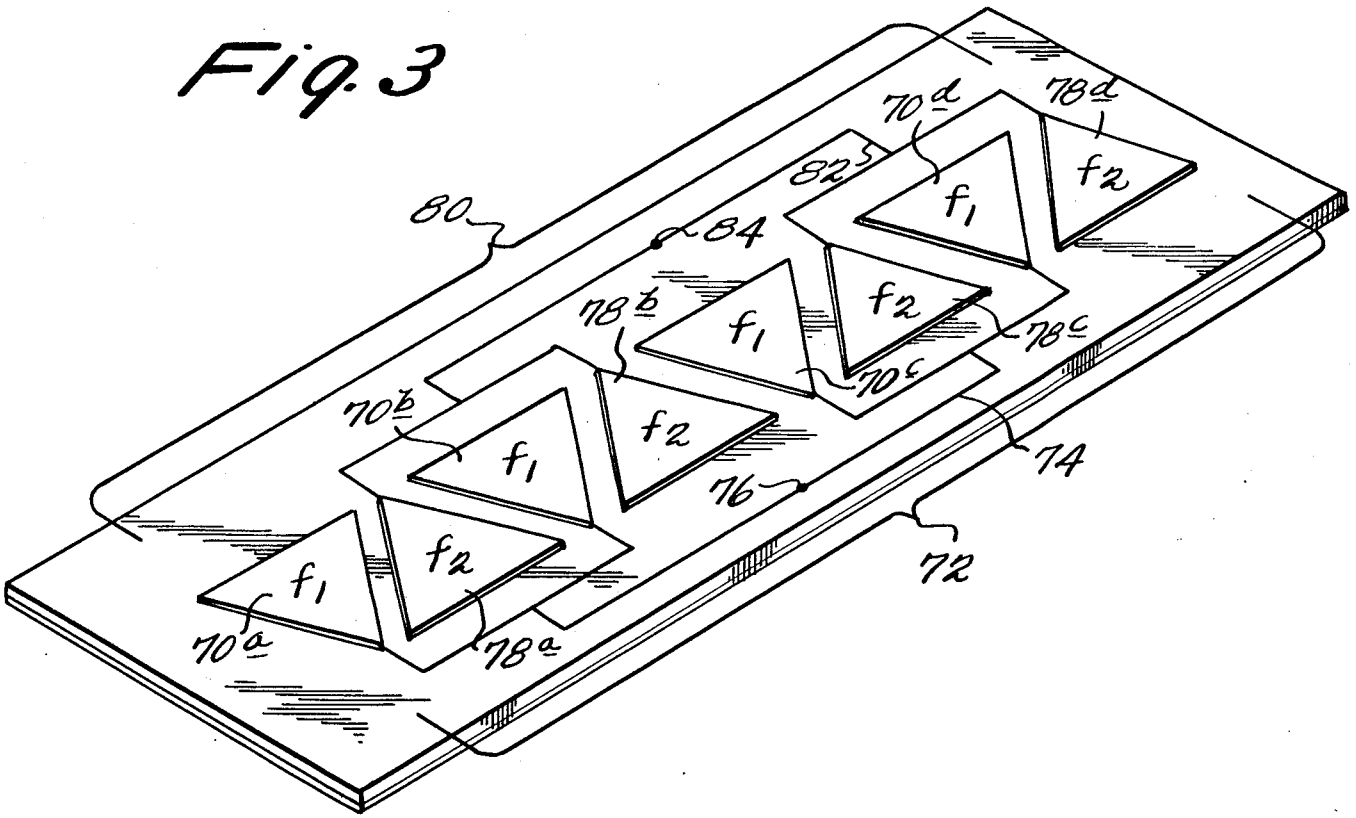

Other objects and advantages of this invention will be more completely understood by reading the following detailed description of the invention taken in conjunction with the accompanying drawings of which:

FIG. is a perspective view of an exemplary embodiment of a microstrip antenna radiator according to this invention;

FIG. 2 is a perspective view of another exemplary embodiment of a microstrip antenna radiator according to this invention; and FIG. 3 is a schematic perspective view of two interleaved arrays of microstrip radiator elements according to this invention.

Referring to FIG. 1, an exemplary embodiment of an antenna radiator according to this invention is shown generally at 10. The radiator element 12 and its integrally formed microstrip feedline 14 are shaped by conventional photo-etching processes on the top side of a conductively clad dielectric sheet 16 while the electrically conductive surface 18 on the bottom side has been retained for a reference or ground plane surface. A copper clad 1/16 inch thick layer of teflon-fiberglass dielectric material would be suitable for use in making the exemplary embodiment shown in FIG. 1. However, as will be appreciated by those in the art, other types of dielectrics and other thicknesses of dielectrics could also be utilized if desired.

Although the radiator element 12 shown in FIG. 1 is seen to be substantially in the general shape of an equilateral triangle, it will also be appreciated by observing FIG. 1 that certain dimensions of this equilateral triangle have been altered. As shown, the basic triangular shape includes spaced apart edges 20, 22 and 24 about the periphery with apices 26, 28 and 30 occurring therebetween. Edge 20 includes a projecting tab portion 32 while edge 22 includes a similar but somewhat differently dimensioned projecting tab portion 34. This structure then defines active radiating slot areas 36, 38 and 40 which are respectively associated with edges 20, 22 and 24 of the essentially triangularly shaped radiator element 12. Furthermore, these active radiating slots have an effective resonant dimension associated therewith along a direction substantially transverse to the edge which defines the slot. That is, as shown in FIG. 1, slot 36 has resonant dimension 42 associated therewith while slot 38 has resonant dimension 44 associated therewith and while slot 40 has resonant dimension 46 associated therewith. As will be appreciated by those in the art, such resonant dimensions may approximate one-half electrical wavelength in the dielectric material 16 at the intended operating frequency.

Another way of considering the resonant dimensions 42, 44 and 46 is to consider that each such resonant dimension effectively determines the radiation impedance of its associated radiation slots 36, 38 and 40 respectively.

When this element is fed at apex 26 through transmission line 14 from a suitable source of radio frequency energy 48, all three of the active radiating slots 36, 38 and 40 are effectively fed. In the particular exemplary embodiment shown in FIG. 1, resonant dimension 42 has been selected to cause slot 36 to be substantially at resonance at the intended operating frequency of source 48. However, resonant dimension 44 is slightly longer than resonant dimension 42 such that it is not quite at true resonance at the operating frequency but, rather, such that the radiation impedance for slot 38 is effectively inductive thus causing the radiation from slot 38 to lag, in electrical phase, the radiation from slot 36. Similarly, resonant dimension 46 is slightly shorter than resonant dimension 42 such that at the operating frequency of source 48 the radiation impedance of slot 40 is effectively capacitive thus causing radiation therefrom to lead, in electrical phase, the radiation from slot 36.

The radiation eminating from any given slot is linearly polarized in a direction parallel to the associated resonant dimension. However, by judicious choice of the leading and lagging phase relationships between radiation emitted from slots 38 and 40 with respect to that emitted from slot 36, elliptical or circular polarizations may be obtained. For example, in the exemplary embodiment of FIG. 1, the radiating slots 36, 38 and 40 are spatially oriented at 120° angular intervals about the periphery of the triangular radiation element 12. Accordingly, if resonant dimensions 44 and 46 are chosen so as to cause the radiation from slot 38 to lag by 120 electrical degrees and the radiation from slot 40 to lead by 120 electrical degrees with respect to the radiation from slot 36, it follows that the combined overall radiation from element 12 will be substantially circularly polarized. Of course, such polarization may be either left-hand or right-hand depending upon whether slot 38 is lagging and slot 40 is leading or whether, conversely, slot 38 is leading and slot 40 is lagging as would be the case, for example, if side 22 of the triangular element 12 had not been altered but rather side 24 had been altered by the inclusion of tab 34.

Another exemplary embodiment of antenna radiator according to this invention is shown in FIG. 2 wherein a radiator element 50 is again substantially shaped as an equilateral triangle. However, in the embodiment of FIG. 2, the resonant dimensions 52, 54 and 56 respectively associated with radiating slots 58, 60 and 62 are altered so as to present the desired different resonant dimensions by flattening or truncating at least two of the triangle apices. By whatever shape alteration the different resonant dimensions are effected, the result is as has already been described for FIG. 1.

Of course, it should also be understood that the resonant dimensions may be defined by some combination or permutation of the alteration techniques depicted in the embodiments of FIGS. 1 and 2. Furthermore, other shape altering techniques for controlling the relative resonant dimensions will also occur to those skilled in the art upon reflection in view of the already described specific exemplary embodiments of this invention. It should also be understood that although the FIG. 1 embodiment happens to depict a resonant dimension 46 that has been unaltered from the basic equilateral triangular dimension, it would also be possible to alter all three of the resonant dimensions so long as the net result is three different resonant dimensions which function as previously described.

While primary emphasis and expectation with respect to this invention is that it will be utilized to transmit or receive circularly or elliptically polarized electromagnetic waves, it is also conceivable that this basically triangularly shaped radiator might be utilized as a multiply resonant structure capable of transmitting-/receiving on multiple frequencies if the various resonant dimensions are sufficiently different such that non-resonant slots are effectively decoupled at the frequency for which another resonant slot is being utilized.

The structure shown in FIG. 3 is actually two interleaved arrays of triangular radiating elements according to this invention. For the sake of simplicity, the triangular radiating elements shown in FIG. 3 are depicted purely schematically and the shape alterations for controlling the relative resonant dimensions in each individual triangular radiator are not explicitly shown in FIG. 3. As should now be apparent, such shape alterations may be in accordance with the embodiments already described in FIGS. 1 and 2, some combination or permutation thereof or some other variation or shape modification for controlling the various resonant dimensions in each radiator element.

Radiator elements 70*a*, 70*b*, 70*c* and 70*d* are connected in a first array 72 by a corporate structured microstrip feedline 74 terminating in a common feed point 76. Similarly, radiator elements 78*a*, 78*b*, 78*c* and 78*d* are connected in another complementary array 80 by a corporate structured microstrip feedline 82 which terminates in another common feed point 84. Typically, elements 70 are designed for operation about a first center frequency while elements 78 are designed for operation at a second center frequency. The arrays are then interleaved as shown in FIG. 3 so as to obtain a two-frequency antenna array capability within a limited available space. Ideally, the radiator elements in each array should be spaced apart from one another by one-half electrical wavelength at the intended frequency of operation for that particular array. Using conventionally shaped square or circular elements for circularlly polarized radiators, such ideal spacing is physically impossible as should be appreciated. However, due to the space saving characteristics of the antenna radiator elements of this invention, such elements may be more closely spaced in an application such as that shown in FIG. 3. In this manner, a more nearly optimum spacing of the individual elements of any given array may be achieved. As an illustrations when the array of FIG. 3 is utilized in a particular application such as a belt antenna, for example, wrapped around a spacecraft or missile, the spacing of individual radiator elements within each array becomes critical for uniform omni-coverage around the vehicle circumference. It should be noted that the two interleaved arrays 72 and 80 of FIG. 3 comprise interleaved radiations 70 for array 72 which are inverted in physical orientation with respect to the interleaved radiators 78 for array 80. In this manner, the total number of such arrayed structures that can be disposed within a given array area is maximized.

While only a few specific exemplary embodiments of this invention have been particularly described above, those skilled in the art will recognize that there are many possible variations and modifications in these particular exemplary embodiments that may be made without materially departing from the novel features and advantages of this invention. Accordingly, all such variations or modifications are intended to be included within the scope of this invention as defined by the appended claims.

What is claimed is:

1. A radio frequency antenna structure comprising:
an electrically conductive reference surface,
a sheet of dielectric material overlying said reference surface,
an electrically conductive antenna element surface spaced from said reference surface by said sheet of dielectric material,
said antenna element surface including three substantially straight edges shaped about its periphery defining three corresponding active linearly extending slot areas, each slot having a different respectively corresponding resonant dimension associated therewith along a direction substantially transverse to the straight edge which defines such slot,
said antenna element surface being shaped such that each of the straight edges lying along at least a portion of a respectively associated one of the three sides of a triangular geometric shape, and
r.f. feed means electrically connected to said antenna element surface for conducting r.f. energy to/from said antenna element surface.

2. A radio frequency antenna structure as in claim 1 wherein:
a first one of said resonant dimensions is substantially resonant at a predetermined frequency,
a second one of said resonant dimensions is below resonance at said predetermined frequency so as to cause its respectively associated active slot to lag in electrical phase by a predetermined amount with respect to the active slot respectively associated with said first resonant dimension, and
the third remaining one of said resonant dimensions is above resonance at said predetermined frequency so as to cause its respectively associated active slot to lead in electrical phase by a predetermined amount with respect to the active slot respectively associated with said first resonant dimension wherein said antenna structure is caused to transmit/receive elliptically or circularly polarized electromagnetic fields.

3. A radio frequency antenna structure comprising:
an electrically conductive reference surface,
a sheet of dielectric material overlying said reference surface,
an electrically conductive antenna element surface spaced from said reference surface by said sheet of dielectric material,
said antenna element surface including three edges spaced about its periphery defining three corresponding active slot areas, each slot having a different respectively corresponding resonant dimension associated therewith along a direction substantially transverse to the edge which defines such slot,
r.f. feed means electrically connected to said antenna element surface for conducting r.f. energy to/from said antenna element surface, and
said antenna element surface being shaped so as to cause said resonant dimensions to intersect in substantially mutually equal angles such that said active slot areas are angularly spaced at substantially 120° intervals about the periphery of said antenna element surface.

4. A radio frequency antenna structure as in claim 3 wherein said antenna element surface is shaped to comprise a substantially three-sided equilateral triangular shape defining the three resonant dimensions as the respectively corresponding successive dimensions measured transversely from each of the three triangle sides to the opposite apex and wherein said equilateral triangular shape is altered so as to make the three resonant dimensions different one from another.

5. A radio frequency antenna structure as in claim 4 wherein at least two of the sides of said equilateral triangular shape have been altered so as to change their respectively associated resonant dimensions.

6. A radio frequency antenna structure as in claim 5 wherein said at least two sides have been extended respectively differing distances from the transversely situated apex.

7. A radio frequency antenna structure as in claim 4 wherein at least two of the apices of said equilateral triangular shape have been altered so as to change their respectively associated resonant dimensions.

8. A radio frequency antenna structure as in claim 7 wherein said at least two apices have been truncated by respectively differing amounts.

9. A radio frequency antenna structure as in claim 4 wherein:

a first one of said resonant dimensions is substantially resonant at a predetermined frequency, a second one of said resonant dimensions is below resonance at said predetermined frequency so as to cause its respectively associated active slot to lag in electrical phase by a predetermined amount with respect to the active slot respectively associated with said first resonant dimension, and the third remaining one of said resonant dimensions is above resonance at said predetermined frequency so as to cause its respectively associated active slot to lead in electrical phase by a predetermined amount with respect to the active slot respectively associated with said first resonant dimension whereby said antenna structure is caused to transmit/receive elliptically or circularly polarized electromagnetic fields.

10. A radio frequency antenna structure as in claim 9 wherein said antenna element is shaped so as to cause said phase lead and said phase lag to be substantially 120 electrical degrees and wherein said antenna element is shaped so as to angularly space said active slot areas at substantially 120 angular degrees about the periphery of said antenna element surface whereby said structure is caused to transmit/receive circularly polarized electromagnetic fields.

11. A radio frequency antenna structure as in claim 10 wherein at least two of the sides of said equilateral triangular shape have been altered so as to change their respectively associated resonant dimensions.

12. A radio frequency antenna structure as in claim 11 wherein said at least two sides have been extended respectively differing distances from the transversely situated apex.

13. A radio frequency antenna structure as in claim 10 wherein at least two of the apices of said equilateral triangular shape have been altered so as to change their respectively associated resonant dimensions.

14. A radio frequency antenna structure as in claim 13 wherein said at least two apices have been truncated by respectively differing amounts.

15. A radio frequency antenna structure comprising a plurality of triangular structures as in claim 4, said structures being connected into two interleaved arrays wherein each array is designed to operate at respectively associated different frequencies, and wherein said interleaved structures for one array are inverted in physical orientation with respect to those in the other array so as to increase the total number of such arrayed structures that can be disposed within a given array area thereby permitting a more nearly optimum spacing of such structure within both of said arrays.

16. A radio frequency antenna structure comprising:

an electrically conductive reference surface, a sheet of dielectric material overlying said reference surface, an electrically conductive antenna element surface spaced from said reference surface by said sheet of dielectric material, said antenna element surface including three edges spaced about its periphery defining three corresponding active slot areas, each slot having a different respectively corresponding resonant dimension associated therewith along a direction substantially transverse to the edge which defines such slot, r.f. feed means electrically connected to said antenna element surface for conducting r.f. energy to/from said antenna element surface, a first one of said resonant dimensions being substantially resonant at a predetermined frequency, a second one of said resonant dimensions being below resonance at said predetermined frequency so as to cause its respectively associated active slot to lag in electrical phase by a predetermined amount with respect to the active slot respectively associated with said first resonant dimension, the third remaining one of said resonant dimensions being above resonance at said predetermined frequency so as to cause its respectively associated active slot to lead in electrical phase by a predetermined amount with respect to the active slot respectively associated with said first resonant dimension whereby said antenna structure is caused to transmit/receive elliptically or circularly polarized electromagnetic fields, said antenna element being shaped so as to cause said phase lead and said phase lag to be substantially 120 electrical degrees, and said antenna element being shaped so as to angularly space said active slot areas at substantially 120 angular degrees about the periphery of said antenna element surface whereby said structure is caused to transmit/receive circularly polarized electromagnetic fields.

* * * * *